United States Patent [19]

Knapp

[11] Patent Number: 4,511,367

[45] Date of Patent: Apr. 16, 1985

[54] CORROSION INHIBITORS FOR ALCOHOL CONTAINING MOTOR FUEL

[75] Inventor: Gordon G. Knapp, Baton Rouge, La.

[73] Assignee: Ethyl Corporation, Richmond, Va.

[21] Appl. No.: 619,977

[22] Filed: Jun. 13, 1984

[51] Int. Cl.[3] ..... C10L 1/18

[52] U.S. Cl. ..... 44/53; 44/56; 252/392

[58] Field of Search ..... 44/53, 56, 63; 252/392

[56] References Cited

U.S. PATENT DOCUMENTS

| | | | |
|---|---|---|---|
| 2,919,979 | 1/1960 | Martin et al. | 44/66 |
| 3,036,902 | 5/1962 | Hamer et al. | 44/63 |
| 3,337,472 | 8/1967 | Littler et al. | 44/63 |
| 4,431,430 | 2/1984 | Sung | 44/53 |
| 4,448,586 | 5/1984 | Weidig | 44/66 |

*Primary Examiner*—Y. Harris-Smith

*Attorney, Agent, or Firm*—Donald L. Johnson; John F. Sierberth; W. G. Montgomery

[57] ABSTRACT

Corrosion caused by gasohol or alcohol motor fuels is inhibited by the addition of a corrosion inhibiting amount of the combination of (A) at least one monoalkenylsuccinic acid wherein the alkenyl group contains about 8 to 30 carbon atoms and (B) a substituted imidazoline, e.g., 2-heptadecenyl-1-(2-hydroxyethyl)imidazoline.

7 Claims, No Drawings

CORROSION INHIBITORS FOR ALCOHOL CONTAINING MOTOR FUEL

BACKGROUND

In the past metal corrosion caused by conventional motor fuels such as gasoline was not much of a problem because such hydrocarbon fuels are inherently non-corrosive. However, with the advent of fuels containing alcohols such as gasohol or straight alcohol fuels, corrosion has become a major problem because such fuels are corrosive. It has been reported that this corrosion is due to the presence of acidic contaminants in such fuels such as formic acid. It is almost impossible to avoid such contaminants because they occur in fuel grade alcohols and are also formed in storage as normal alcohol oxidation products.

It is known from U.S. Pat. No. 2,993,772 that alkenyl succinic acids as well as their anhydrides inhibit and/or prevent the deposit-forming tendency of hydrocarbon fuels during combustion and/or modify the deleterious effect of the formed deposits in both leaded and unleaded fuels particularly in gasoline and jet fuels. The substituted imidazoline co-additives of this invention, more fully described hereafter, also are known compounds and have found use, for example, in motor fuel compositions to prevent carburetor icing as disclosed in U.S. Pat. No. 3,036,902. It has now been discovered that a combination of the substituted imidazolines of the present invention with a monoalkenylsuccinic acid wherein the alkenyl group contains about 8 to 30 carbon atoms provides corrosion inhibiting properties to fuels containing alcohols such as gasohol or straight alcohol fuels.

SUMMARY

According to the present invention metal corrosion caused by alcohol-type motor fuels is inhibited by adding to the fuel the combination of (A) at least one monoalkenylsuccinic acid wherein the alkenyl group contains about 8 to 30 carbon atoms and (B) a substituted imidazoline, e.g., 2-heptadecenyl-1-(2-hydroxyethyl-)imidazoline.

DESCRIPTION OF PREFERRED EMBODIMENTS

The invention provides a liquid fuel adapted for use in an internal combustion engine said fuel comprising from 5 to 100 weight percent of one or more alcohols, from 0 to 95 weight percent gasoline and a corrosion inhibiting amount of the combination of (A) at least one monoalkenylsuccinic acid wherein the alkenyl group contains about 8 to 30 carbon atoms and (B) a substituted imidazoline, e.g., 2-heptadecenyl-1-(-2-hydroxyethyl)imidazoline.

The additive combination of this invention can be beneficial in any engine fuel containing or consisting of an oxygenate. Such fuels include gasoline-alcohol mixtures referred to as "gasohol" as well as straight alcohol fuels. Useful alcohols are methanol, ethanol, n-propanol, isopropanol, 1-butanol, 2-butanol, t-butanol, 2-methyl-2-propanol, isobutanol, mixtures thereof, such as methanol and t-butanol and the like. Gasohols usually contain about 2 to 30 volume percent alcohol. At concentrations above 10 volume percent phase separation problems are encountered especially in the presence of water.

Phase separation can be minimized by including co-solvents in the gasohol such as ethers, ketones, esters and the like. An especially useful co-solvent is methyl tert-butyl ether which also serves to increase octane value.

The additive combination may be used at a concentration which provides the required amount of corrosion protection. A useful range is about 1 to 5000 pounds per thousand barrels (ptb). A more preferred range is about 5 to 2000 ptb and the most preferred concentration is 5 to 500 ptb.

The monoalkenylsuccinic acids (Component A) are well known in the art. These acids are readily prepared by the condensation of an olefin with maleic anhydride followed by hydrolysis (see U.S. Pat. No. 2,133,734 and U.S. Pat. No. 2,741,597). Suitable monoalkenylsuccinic acids include octenylsuccinic acid, decenylsuccinic acid, undecenylsuccinic acid, dodecenylsuccinic acid, pentadecenylsuccinic acid, octadecenylsuccinic acid and isomers thereof having alkenyl groups of various hydrocarbon structures. The preferred monoalkenylsuccinic acid is dodecenylsuccinic acid, more preferably, dodecenylsuccinic acid prepared from propylene tetramer.

While an alkenyl group ranging from 8 to 30 carbon atoms is preferred as indicated above, it is contemplated that substantially any alkenylsuccinic acid or its equivalent anhydride may be employed in the fuels of the present invention provided it is sufficiently soluble in the fuel to be effective in combination with the substituted imidazoline compounds of the invention as a corrosion inhibitor. Further, since relatively pure olefins are difficult to obtain and are often too expensive for commercial use, alkenylsuccinic acids prepared as mixtures by reacting mixed olefins with maleic anhydride may be employed in this invention as well as relatively pure alkenyl succinic acids. Mixed alkenylsuccinic acids wherein the alkenyl group averages 6–8, 8–10 and 10–12 carbon atoms are commercially available.

Component B of the combination is a substituted imidazoline.

The substituted imidazoline used in this invention can be represented by the following general structure:

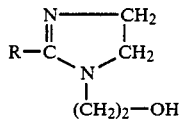

(I)

in which R is a hydrocarbon alkenyl group having from about 7 to about 24 carbon atoms.

The imidazolines having Formula I which are useful in this invention are readily obtained by reacting suitable organic acids with N-(2-hydroxyethyl)ethylene diamine. This reaction involves the elimination of 2 molecules of water between the acid and the amine. This reaction is represented by the following equation:

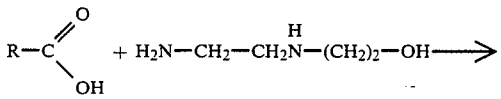

-continued

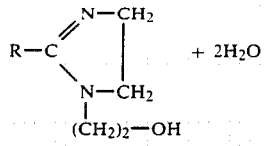

In addition to the imidazoline, small amounts of a corresponding linear amino amide are also obtained. This amino amide is the result of eliminating only one molecule of water between the acid and the amine. Methods of preparing the imidazolines are well known. Useful procedures are described in Wilson, U.S. Pat. No. 2,267,965, and Wilkes, U.S. Pat. No. 2,214,152. As can be seen from the reaction equation given above, the R group in the imidazoline is the alkenyl residue of the particular acid which is used in its preparation. In other words, the R group will have one carbon atom less than the acid which is used to prepare the imidazoline.

Acids which are useful in preparing the imidazolines are hydrocarbon mono-carboxylic acids having up to about 20 carbon atoms. The preferred acids are unsaturated organic acids such as 9,10 decylenic acid, octenoic acid, oleic acid, linoleic acid and the like. Preferred acids are commonly obtained as hydrolysis products of natural materials. These acids thus obtained are mixtures. For example, acids obtained from olive oil, typically are a mixture of about 83 percent oleic acid, 6 percent palmitic acid, 4 percent stearic acid and 7 percent linoleic acid. This mixture is quite useful for preparing imidazolines to be used in this invention. Organic acid mixtures obtained on saponifying and acidulating babassu oil, castor oil, peanut oil, palm oil and the like, are examples of useful acids. Several imidazoline compounds which can be used in the present invention are available commercially. A preferred imidazoline is 2-heptadecenyl-1-(2-hydroxyethyl)imidazoline.

The weight ratio of component A to component B in the combination can vary over a wide range such as 1 to 10 parts A to 1 to 10 parts B. In a more preferred embodiment the weight ratio is about 0.5–5 parts component A for each part component B. In a still more preferred embodiment there are 0.6–4.0 parts component A per each part component B. The most preferred ratio is 1:1.

Components A and B can be separately added to the fuel. More preferably components A and B are premixed to form a package and this package is added to the fuel in an amount sufficient to provide the required degree of corrosion protection.

Most preferably components A and B are also premixed with a solvent to make handling and blending easier. Suitable solvents include alcohols (e.g., methanol, ethanol, isopropanol), ketones (acetone, methyl ethyl ketone), esters (tert-butyl acetate) and ethers (e.g., methyl tert-butyl ether).

Aromatic hydrocarbons are very useful solvents. These include benzene, toluene, xylene and the like. Excellent results can be obtained using xylene.

The concentration of the active components A and B in the package can vary widely. For example the active content can range from about 5 weight percent up to the solubility limit of A or B in the solvent. With xylene a total active content of about 5–60 weight percent is generally used, especially about 50 weight percent.

Tests were conducted to measure the anti-corrosion properties of the additive combination. In the tests, the corrosion of steel cylinder rods ($\frac{1}{8}$ in. × 3 in.) semisubmersed in test fluid was measured under different test conditions. The rods were first cleaned with carborundum 180, polished with crocus cloth, washed with acetone and then dried at room temperature.

Each rod was weighed and then semisubmersed in 10 milliters of the test fluid in a sealed bottle for the specified time at the specified temperature.

At the end of the test period, the rods were removed from the fuel, and after loose deposits were removed with a light brush, the rods were washed and dried as at the start of the test and then reweighed. Any change in rod weight was recorded. Loss of weight indicated corrosion.

A series of three tests were carried out lasting 7 days, 14 days and 30 days, respectively. The series of tests were conducted in fuels comprising 5 volume percent methanol and 5 volume percent t-butanol in gasoline (indolene) containing 0.5 weight percent of 5.0 percent acetic acid in water. The tests were conducted at 25° C.

The test additives added to the test fuels were equal weight mixtures (100 ptb) of either dodecenylsuccinic acid prepared from dodecene or propylene tetramer in combination with 2-heptadecenyl-1-(2-hydroxyethyl-)imidazoline and 50 ptb of each individual component.

The results of these tests which are set out in the table below demonstrate the excellent anticorrosion properties of a fuel containing an additive combination of the invention.

TABLE

| Additives | Weight reduction (mg.) |
|---|---|
| 7-DAY TESTS | |
| none | 7.5 |
| 2-heptadecenyl-1-(2-hydroxyethyl)imidazoline | 5.6 |
| dodecenylsuccinic acid from dodecene | 5.7 |
| dodecenylsuccinic acid from propylene tetramer | 3.8 |
| 2-heptadecenyl-1-(2-hydroxyethyl)imidazoline + dodecenylsuccinic acid from dodecene | 0.1 |
| 2-heptadecenyl-1-(2-hydroxyethyl)imidazoline + dodecenylsuccinic acid from propylene tetramer | 0.1 |
| 14-DAY TESTS | |
| none | 10.3 |
| 2-heptadecenyl-1-(2-hydroxyethyl)imidazoline | 5.7 |
| dodecenylsuccinic acid from dodecene | 10.5 |
| dodecenylsuccinic acid from propylene tetramer | 8.9 |
| 2-heptadecenyl-1-(2-hydroxyethyl)imidazoline + dodecenylsuccinic acid from dodecene | 0.4 |
| 2-heptadecenyl-1-(2-hydroxyethyl)imidazoline + dodecenylsuccinic acid from propylene tetramer | 0.2 |
| 30-DAY TESTS | |
| none | 12.1 |
| 2-heptadecenyl-1-(2-hydroxyethyl)imidazoline | 4.4 |
| dodecenylsuccinic acid from dodecene | 15.1 |
| dodecenylsuccinic acid from propylene tetramer | 15.1 |
| 2-heptadecenyl-1-(2-hydroxyethyl)imidazoline + dodecenylsuccinic acid from dodecene | 0.9 |
| 2-heptadecenyl-1-(2-hydroxyethyl)imidazoline + dodecenylsuccinic acid from propylene tetramer | 0.9 |

I claim:

1. A liquid fuel adapted for use in an internal combustion engine, said fuel consisting essentially of 5 to 100 weight percent of one or more alcohols, 0 to 95 weight percent gasoline and a corrosion inhibiting amount of a combination of (A) at least one substituted imidazoline having the structural formula:

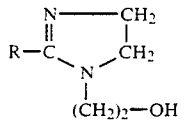

in which R is a hydrocarbon alkenyl group having from about 7 to 24 carbon atoms and (B) at least one monoalkenylsuccinic acid in which the alkenyl group contains about 8 to 30 carbon atoms.

2. A liquid fuel of claim 1 wherein said substituted imidazoline is 2-heptadecenyl-1-(hydroxyethyl-)imidazoline.

3. A liquid fuel of claim 2 wherein said monoalkenylsuccinic acid is dodecenylsuccinic acid.

4. A corrosion inhibiting concentrate consisting essentially of a solvent containing 5 to 60 weight percent of a combination of (A) at least one substituted imidazoline having the structural formula

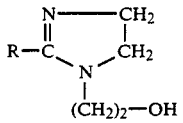

in which R is a hydrocarbon alkenyl group having from about 7 to 24 carbon atoms and (B) at least one monoalkenylsuccinic acid in which the alkenyl group contains about 8 to 30 carbon atoms.

5. A corrosion inhibiting concentrate of claim 4 in which said substituted imidazoline is 2-heptadecenyl-1-(hydroxyethyl)-imidazoline.

6. A corrosion inhibiting concentrate of claim 5 wherein monoalkenylsuccinic acid is dodecenylsuccinic acid.

7. A liquid fuel adapted for use in an internal combustion engine, said fuel consisting essentially of a major amount of a hydrocarbon distillate in the gasoline distillation range and from about 2 to about 30 volume percent of one or more alkanols containing from abut 1 to about 4 carbon atoms and a corrosion inhibiting amount of a combination of (A) at least one substituted imidazoline having the structural formula

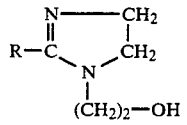

in which R is a hydrocarbon alkenyl group having from about 7 to 24 carbon atoms and (B) at least one monoalkenylsuccinic acid in which the alkenyl group has about 8 to 30 carbon atoms.

* * * * *